US005954894A

United States Patent [19]

Tsushima

[11] Patent Number: 5,954,894

[45] Date of Patent: Sep. 21, 1999

[54] BEARING STEEL PART FOR ROLLING BEARING

[75] Inventor: Noriyuki Tsushima, Mie, Japan

[73] Assignee: NTN Corporation, Osaka, Japan

[21] Appl. No.: 08/936,021

[22] Filed: Sep. 23, 1997

[30] Foreign Application Priority Data

Sep. 26, 1996 [JP] Japan ..... 8-254563

[51] Int. Cl.[6] ..... C23C 8/22

[52] U.S. Cl. ..... 148/319; 148/906; 384/912

[58] Field of Search ..... 148/319, 906; 384/912

[56] References Cited

U.S. PATENT DOCUMENTS 4,358,317 11/1982 Abe .

5,560,787 10/1996 Takagi et al. ..... 148/319

FOREIGN PATENT DOCUMENTS 62-132031 6/1987 Japan .

*Primary Examiner*—John Sheehan

*Attorney, Agent, or Firm*—McDermott, Will & Emery

[57] ABSTRACT

A bearing steel part for a rolling bearing having a core portion and a high hardness region formed by carburization to cover the core portion is provided in which the composition of at least the core portion contains at least 0.15 wt. % and at most 0.20 wt. % of C, at least 4 wt. % and at most 7 wt. % of Cr, at least 1 wt. % and at most 3 wt. % of Mo, and at least 0.4 wt. % and at most O.9 wt. % of V, with Fe group as base material. Therefore, the bearing steel part for the rolling bearing can be obtained having a better rolling contact fatigue life realized by increasing the core hardness of carburized steel and also having a high fracture toughness value.

4 Claims, 4 Drawing Sheets

BEARING STEEL PART FOR ROLLING BEARING

BACKGROUND OF THE INVENTION

1. Field of the Invention

The present invention relates to a bearing steel part for a rolling bearing and more particularly to a bearing steel part for a rolling bearing used for high speed operation in a gas turbine engine, a machine tool and so on.

2. Description of the Background Art

AISI M50 which is highly heat-resistant Cr—Mo—V based high speed tool steel and its improvement M50 NiL have been used as steels of bearing parts, for example, for gas turbine engines. However, the development of material having higher fracture toughness is currently required for higher speed.

In short, for higher speed, a dn value (a product of the inner diameter d of a bearing part and its rotational speed n), an index indicating the heaviness of a load on the bearing part, is larger, and the bearing part should resist to the heavier load. The larger dn value causes larger tensile stress to the bearing part. If a crack is caused, a crack growth rate may be increased and it may lead to a damage of the bearing. Therefore, material having higher fracture toughness should be developed in order to suppress the crack growth.

For this purpose, Japanese Patent Laying-Open No. 7-252598 discloses martensite-based steel of the Fe group containing at most 0.4 wt. % of C (carbon), 2–7 wt. % of Cr (chromium), 3–20 wt. %, as W equivalent weight (W+2Mo), of one or two of W (tungsten) and Mo (molybdenum), and 0.5–1.1 wt. % of V (vanadium). With this composition, this martensite-based steel improves the fracture toughness value of the bearing part without lowering its hardness.

However, the hoop stress of at least 400 MPa is imposed on a bearing used at the dn value of at least 4 million when the bearing is rotated. Although the fracture toughness value of at least 80 $MPam^{1/2}$ is necessary to prevent crack growth against this hoop stress, such a high fracture toughness value cannot be achieved with the existing material as above.

There is a great demand for higher speed in machine tools as well. The dn value of 3.5 million has been achieved in angular ball bearings by a lubrication method combining under-race lubrication and jet lubrication. However, development of a bearing which can be used at the dn value of 4 million is desired. In order to achieve this, material having the aforementioned fracture toughness value should be developed.

Higher durability as a bearing, that is, higher rolling contact fatigue strength is also important especially for gas turbine engines. For improving the rolling contact fatigue strength, Japanese Patent Laying-Open No. 62-132031 discloses increasing the core hardness of bearing steel, or carburized steel in this case, to at least HRC 48. On the other hand, decreasing the core hardness has been known as a way of improving the fracture toughness value of the carburized steel. In short, when the core hardness of the bearing part is increased to improve its rolling contact fatigue strength, the fracture toughness value of the bearing part is lowered. Thus, the fracture toughness value and the hardness are incompatible characteristics. In order to obtain a sufficiently superior rolling contact fatigue life characteristic under the condition of the higher dn value, it is desirable to enhance the fracture toughness and the hardness without sacrificing either of these characteristics.

SUMMARY OF THE INVENTION

An object of the present invention is to provide a bearing steel part for a rolling bearing having a better rolling contact fatigue life obtained through increasing the core hardness of carburized steel and also having a high fracture toughness value.

The inventor paid attention to and carefully examined a bearing steel part for a rolling bearing prepared through carburization, used specific ingredients and composition for the bearing steel part, and obtained a bearing steel part for a rolling bearing having a high fracture toughness value and also having a better rolling contact fatigue life obtained by increasing the core hardness of carburized steel.

Therefore, the bearing steel part for the rolling bearing according to the present invention having a core portion and a high hardness region (case) formed by carburization to cover the core portion is provided in which the composition of at least the core portion contains at least 0.15 wt. % and at most 0.20 wt. % of C, at least 4 wt. % and at most 7 wt. % of Cr, at least 1 wt. % and at most 3 wt. % of Mo, and at least 0.4 wt. % and at most 0.9 wt. % of V, with Fe (iron) group as base material.

Preferably, the hardness HRC of the core portion is at least 47 and at most 50, and the hardness HRC of the high hardness region is at least 58.

Preferably, the bearing steel part for the rolling bearing according to the present invention has inner and outer bearing rings and a rolling element positioned between the inner and outer bearing rings, and the depth of the high hardness region from the surface of the rolling element is at least 140% of the depth of the high hardness region from the surface of the bearing ring.

As a result, even if the rolling element receives loads from both inner and outer ring sides, spalling of the rolling element prior to that of the bearing rings (inner and outer rings) is prevented, thus improving the bearing life further.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will be described below.

First, a test sample for the fracture toughness (an beam type test sample of 10 mm×15 mm×60 mm) and a test sample for the rolling contact fatigue life (a cylindrical sample of Φ12 mm×22 mm) are formed from materials containing the Fe group-based ingredients shown in the following Table 1. For the fracture toughness test, to evaluate the core portion of the bearing part, the test sample was not carburized, and it was quenched from 1100° C. and tempered twice at 550° C.. For the rolling contact fatigue life test, the test sample was carburized at 950° C. for 24 hours, quenched from 1100° C., and tempered twice at 550° C.

TABLE 1

| Steel | Chemical Ingredients (wt %) | | | | | | | |
|---|---|---|---|---|---|---|---|---|
| type | C | Si | Ni | Cr | Mo | V | Remarks | |
| A | 0.17 | 0.21 | 3.34 | 2.98 | 2.53 | 0.79 | Comparative steel | Cr amount variation |
| B | 0.18 | 0.20 | 3.38 | 3.48 | 2.55 | 0.81 | | |
| C | 0.18 | 0.20 | 3.34 | 4.04 | 2.51 | 0.78 | Steel of the invention | |
| D | 0.17 | 0.22 | 3.33 | 4.96 | 2.61 | 0.81 | | |
| E | 0.16 | 0.21 | 3.41 | 6.03 | 2.50 | 0.79 | | |
| F | 0.17 | 0.21 | 3.30 | 6.97 | 2.54 | 0.80 | | |
| G | 0.17 | 0.20 | 3.37 | 8.02 | 2.57 | 0.80 | Comparative steel | |
| H | 0.16 | 0.21 | 3.36 | 8.52 | 2.49 | 0.80 | | |
| I | 0.17 | 0.20 | 3.33 | 5.12 | 3.00 | 0.78 | Steel of the invention | Mo amount variation |
| J | 0.18 | 0.21 | 3.39 | 4.98 | 3.52 | 0.83 | Comparative steel | |
| K | 0.17 | 0.22 | 3.43 | 6.00 | 2.50 | 0.50 | Steel of the invention | V amount variation |
| L | 0.17 | 0.22 | 3.31 | 6.03 | 2.51 | 0.89 | | |
| M | 0.16 | 0.20 | 3.41 | 6.11 | 2.49 | 1.01 | Comparative steel | C amount variation |
| N | 0.07 | 0.21 | 3.31 | 6.01 | 2.51 | 0.78 | | |
| O | 0.11 | 0.20 | 3.40 | 6.02 | 2.54 | 0.80 | | |
| P | 0.13 | 0.19 | 3.39 | 6.03 | 2.53 | 0.79 | | |
| Q | 0.14 | 0.21 | 3.38 | 6.00 | 2.51 | 0.76 | | |
| R | 0.19 | 0.20 | 3.41 | 6.01 | 2.52 | 0.75 | Steel of the invention | |
| S | 0.21 | 0.19 | 3.42 | 6.02 | 2.52 | 0.81 | Comparative steel | |
| T | 0.23 | 0.22 | 3.29 | 6.05 | 2.52 | 0.81 | | |
| M50 | 0.83 | 0.19 | 0.08 | 4.17 | 4.25 | 1.02 | | Currently used steel |
| M50 NiL | 0.13 | 0.21 | 3.41 | 4.26 | 4.25 | 1.21 | | |

Figure 1:
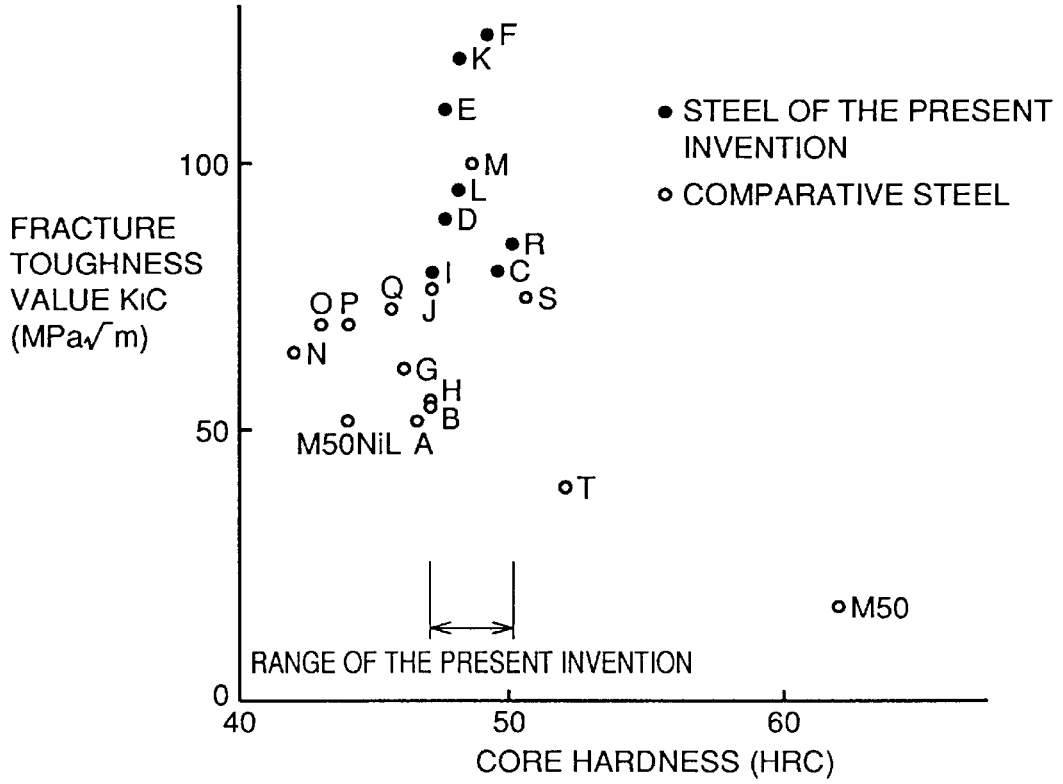
FIG. 1 is a graph showing the relationship between the core hardness and the fracture toughness value $K_IC$.
Figure 2:
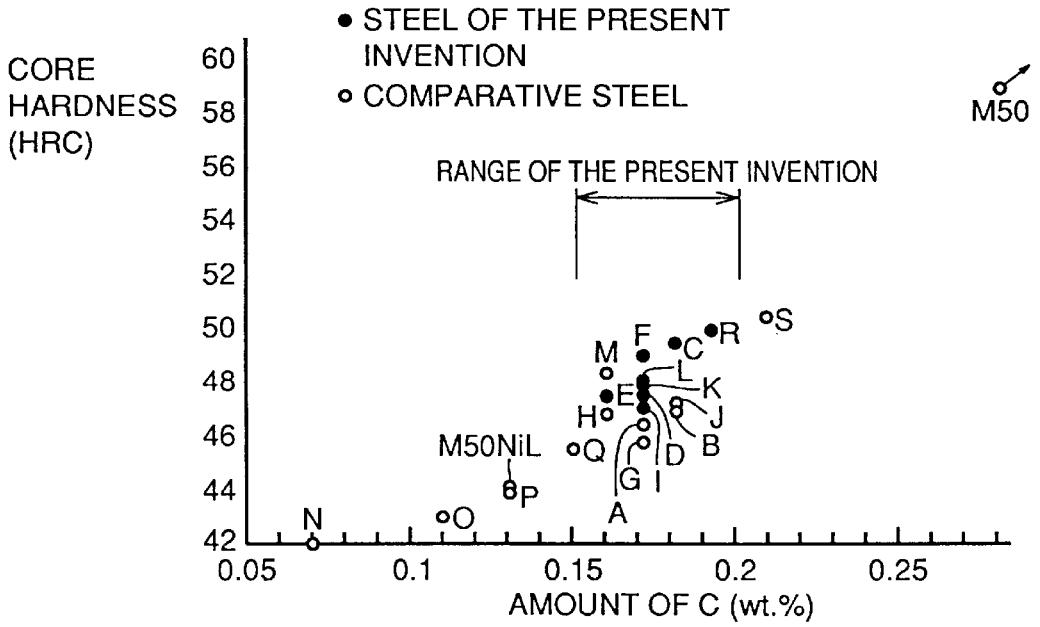
FIG. 2 is a graph showing the relationship between the amount of C and the core hardness.
Figure 3:
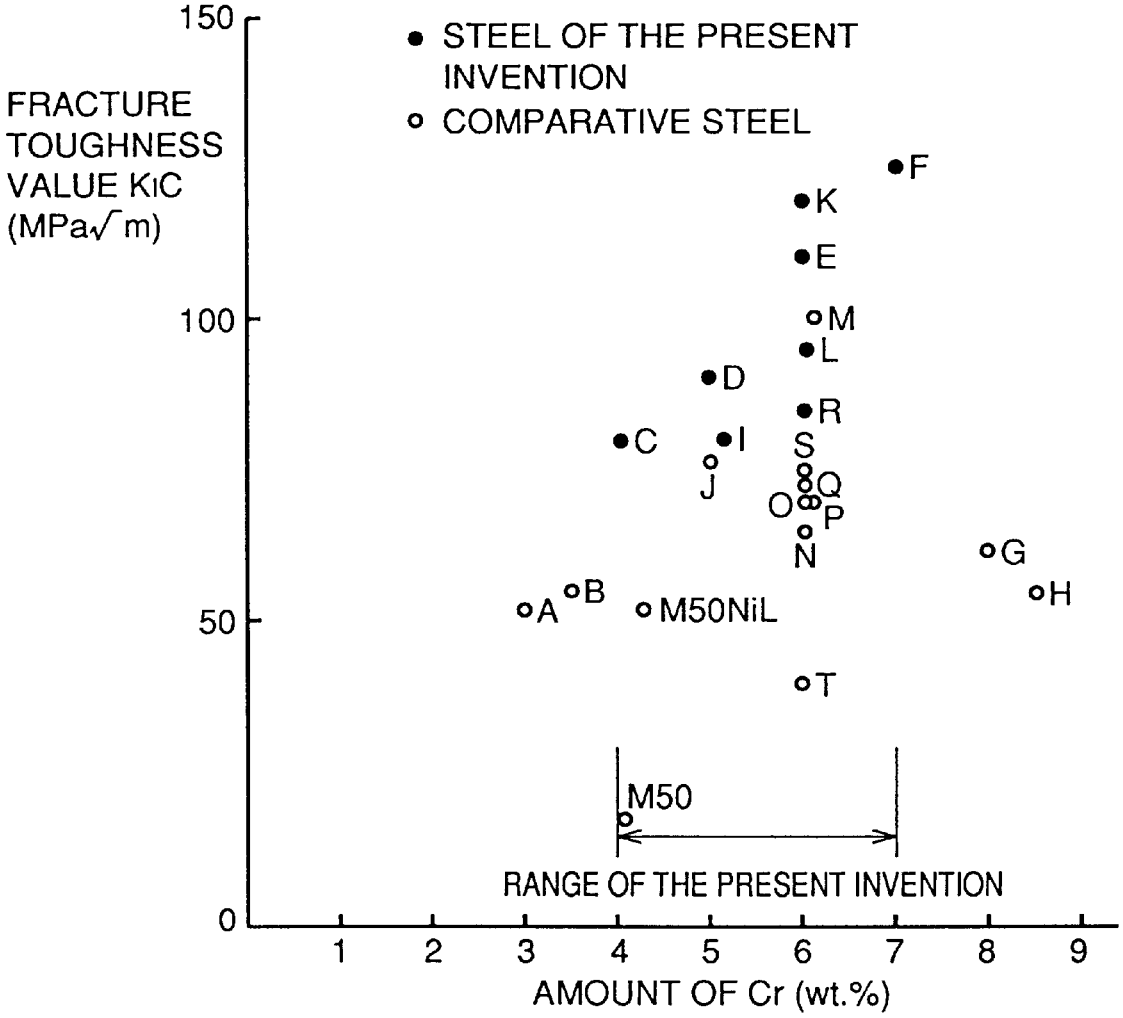
FIG. 3 is a graph showing the relationship between the amount of Cr and the fracture toughness value $K_IC$.
Figure 4A:
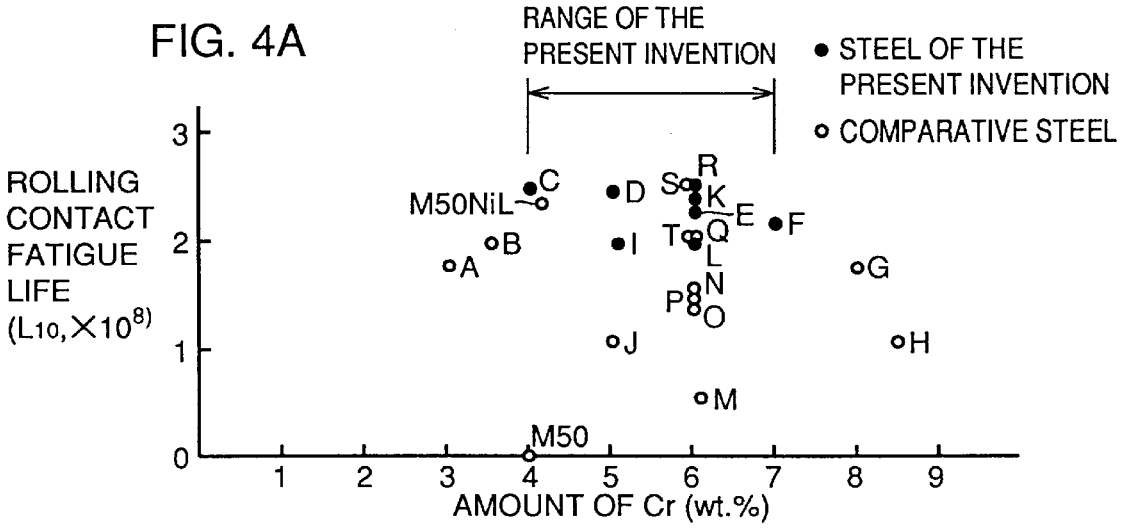
FIG. 4A is a graph showing the relationship between the amount of Cr and the rolling life.
Figure 4B:
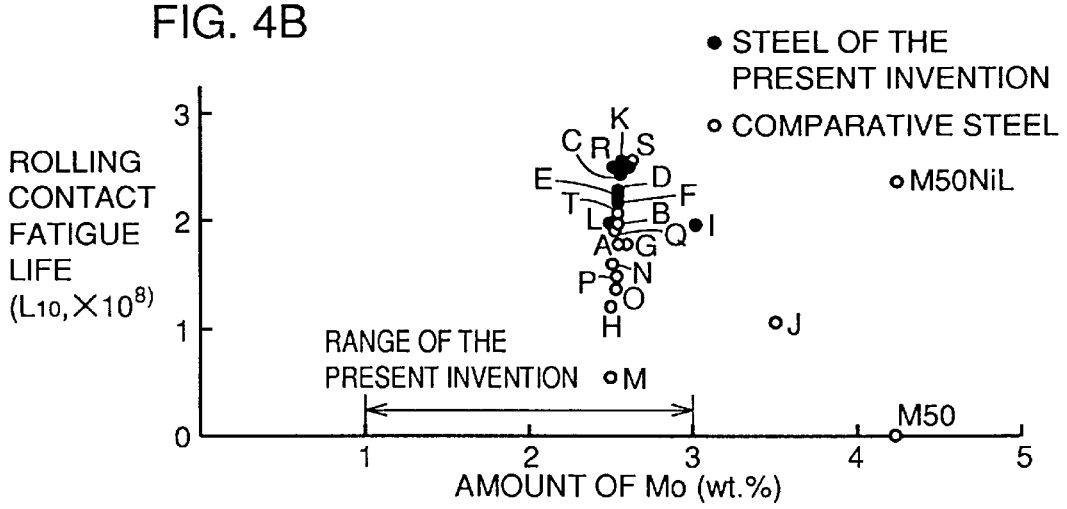
FIG. 4B is a graph showing the relationship between the amount of Mo and the rolling life.
Figure 4C:
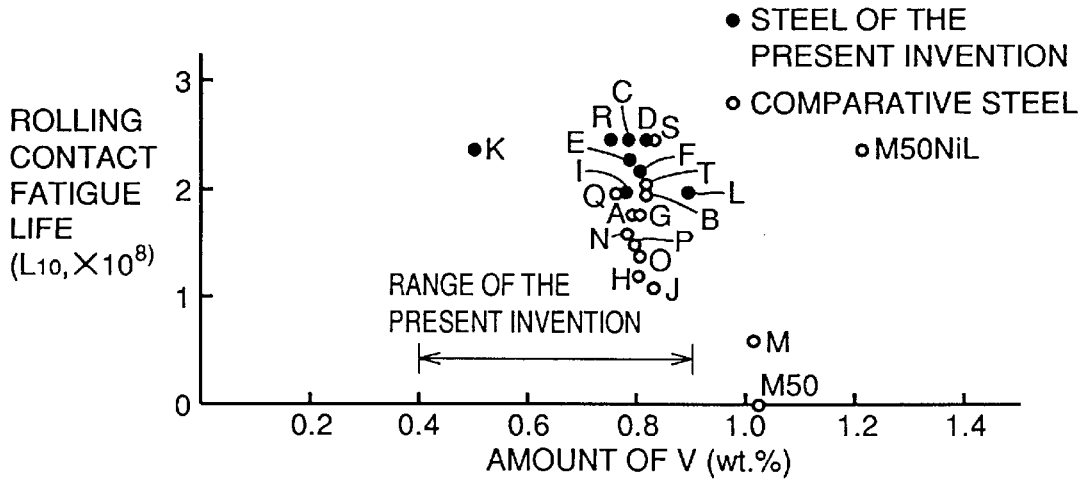
FIG. 4C is a graph showing the relationship between the amount of V and the rolling life.

The results of the fracture toughness test and rolling contact fatigue life test and the hardness measurements are shown in the following Table 2, and respective relationships are shown in FIGS. 1–3 and FIGS. 4A–4C. Here, FIG. 1 illustrates the relationship between the core hardness and the fracture toughness value $K_IC$, FIG. 2 illustrates the relationship between the amount of C and the core hardness, and FIG. 3 illustrates the relationship between the amount of Cr and the fracture toughness value $K_IC$. FIGS. 4A–4C illustrate the relationships between the rolling contact fatigue life and each of the amounts of Cr, Mo and V.

TABLE 2

| Steel type | $K_IC$ (MPam½) | Rolling contact fatigue life (times) | Core hardness (HRC) | Remarks | |
|---|---|---|---|---|---|
| A | 52 | $1.8 \times 10^8$ | 46.5 | Comparative steel | Cr amount variation |
| B | 55 | $2.0 \times 10^8$ | 47.0 | | |
| C | 80 | $2.5 \times 10^8$ | 49.5 | Steel of the invention | |
| D | 90 | $2.5 \times 10^8$ | 47.5 | | |
| E | 110 | $2.3 \times 10^8$ | 47.5 | | |
| F | 125 | $2.2 \times 10^8$ | 49.0 | | |
| G | 62 | $1.8 \times 10^8$ | 46.0 | Comparative steel | |
| H | 55 | $1.2 \times 10^8$ | 47.0 | | |
| I | 80 | $2.0 \times 10^8$ | 47.0 | Steel of the invention | Mo amount variation |
| J | 77 | $1.1 \times 10^8$ | 47.0 | Comparative steel | |
| K | 120 | $2.4 \times 10^8$ | 48.0 | Steel of the invention | V amount variation |
| L | 95 | $2.0 \times 10^8$ | 48.0 | | |
| M | 100 | $5.7 \times 10^8$ | 48.5 | Comparative steel | C amount variation |
| N | 65 | $1.6 \times 10^8$ | 42.0 | | |
| O | 70 | $1.4 \times 10^8$ | 43.0 | | |
| P | 70 | $1.5 \times 10^8$ | 44.0 | | |
| Q | 73 | $2.0 \times 10^8$ | 45.5 | | |
| R | 85 | $2.5 \times 10^8$ | 50.0 | Steel of the invention | |
| S | 75 | $2.5 \times 10^8$ | 50.5 | Comparative steel | |
| T | 40 | $2.1 \times 10^8$ | 52.0 | | |
| M50 | 18 | $4.0 \times 10^6$ | 62.0 | | Currently used steel |
| M50NiL | 52 | $2.4 \times 10^8$ | 44.0 | | |

The surface hardness of all rolling contact fatique test samples is HRC 62–64.

From Table 2 and FIGS. 1 and 2, the fracture toughness value $K_IC$ is at its targeted value of at least 80 $MPam^{1/2}$ when the core hardness is at least HRC 47 and at most HRC 50. Since the core hardness exceeds HRC 50 when the amount of carbon is more than 0.20 wt. %, the upper limit of the carbon amount is 0.20 wt. %. Since the core hardness is below HRC 47 when the amount of carbon is less than 0.15 wt. %, the lower limit of the carbon amount is 0.15 wt. %. Therefore, the range of the carbon amount is at least 0.15 wt. % and at most 0.20 wt. %.

From Table 2 and FIG. 3, when the amount of Cr is varied, the fracture toughness value $K_IC$ increases until the amount of Cr reaches 7 wt. %. However, the fracture toughness value $K_IC$ abruptly decreases when the amount of Cr exceeds 7 wt. %. When the amount of Cr is less than 4 wt. %, the fracture toughness value $K_IC$ of 80 $MPam^{1/2}$ is not obtained. Therefore, the range of the amount of Cr is at least 4 wt. % and at most 7 wt. %. Within the range of at least 4 wt. % and at most 7 wt. %, a long rolling contact fatigue life is also obtained as shown in FIG. 4A.

Here, Mo and V contribute to improving heat resistance, and allow bearings for gas turbine engines to be used at a high temperature by increasing the high temperature hardness. However, Mo and V form hard carbides and lower the rolling contact fatigue strength if Mo and V are added excessively. From Table 2 and FIGS. 4B and 4C, the amount of addition not affecting the rolling contact fatigue life is up to 3 wt. % for Mo and 0.9 wt. % for V, and these amounts are their respective upper limits. The lower limits are 1 wt. % for Mo and 0.4 wt. % for V from the viewpoint of the high temperature hardness. Therefore, the range of the amount of Mo is at least 1 wt. % and at most 3 wt. %, while the range of the amount of V is at least 0.4 wt. % and at most 0.9 wt. %.

It can be seen from Table 2 that examples of the steel according to the present invention have almost the same rolling fatigue lives as the comparative steel M50 NiL currently used, and also have the fracture toughness values $K_IC$ about two times as high as M50 NiL. As compared with M50 conventionally used for bearings for gas turbine engines, it can be seen that the steel of the present invention is excellent both in the rolling contact fatigue life and the fracture toughness value $K_IC$.

From the results above, it is apparent that the bearing steel part for the rolling bearing having a core portion and a high hardness region formed to cover the core portion can have a better rolling contact fatigue life as the core hardness of carburized steel is increased and can also have a high fracture toughness value $K_IC$, if the composition of at least the core portion contains at least 0.15 wt. % and at most 0.20 wt. % of C, at least 4 wt. % and at most 7 wt. % of Cr, at least 1 wt. % and at most 3 wt. % of Mo, and at least 0.4 wt. % and at most 0.9 wt. % of V with Fe group as base material.

Normally, a rolling element is used being positioned between inner and outer bearing rings. The rolling element receives loads from both inner and outer ring sides. If the rolling element is used under severe conditions. The rolling element apts to deform plastically because it transfers less heat than bearing rings and experiences great temperature increase. It is expected the bearing has its rolling element failed prior to its bearing rings, thus ending its life.

The inventor of the present application carried out a bearing life test when the case depth of the region having at least HRC 58 (hereinafter referred to as "case depth of HRC 58") from the surface of the rolling bearing was varied, and examined how the case depth correlates with the life.

For the bearing life test, a tapered roller bearing (model number:30206) was formed of steel E of the present invention shown in Table 1, and tested with oil bath lubrication by rotating it at the speed of 2000 rpm under the load of 1800 kgf. The results are as shown in FIG. 5.

Figure 5:
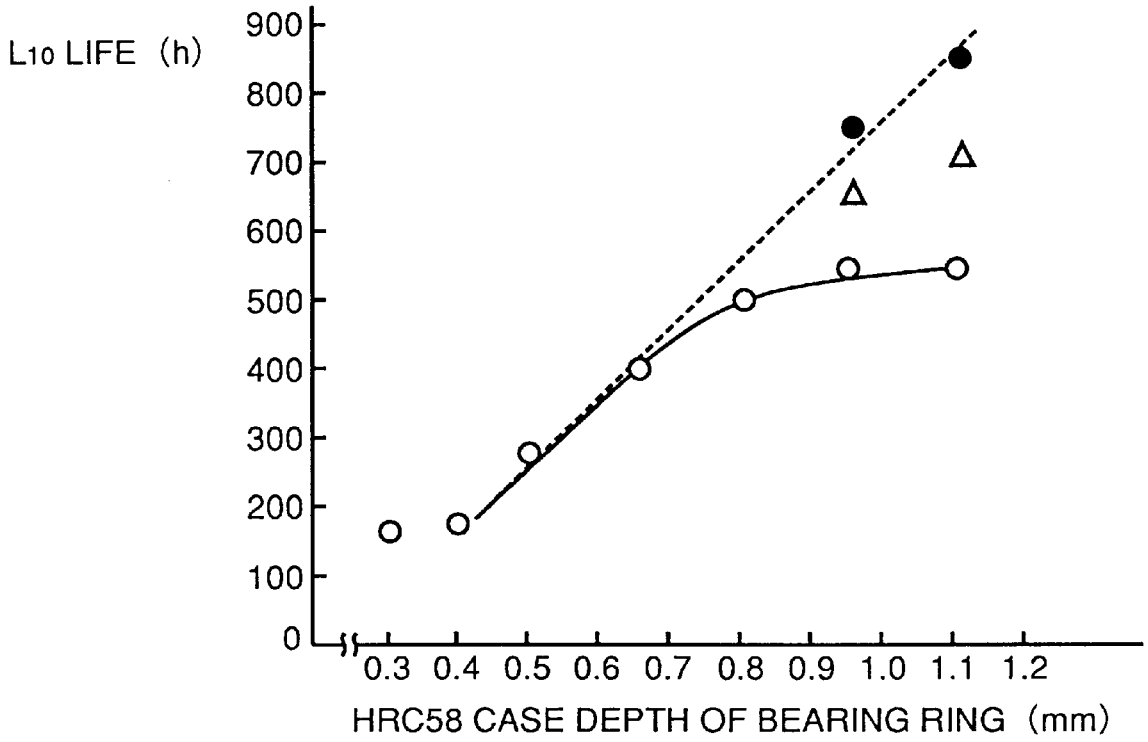
FIG. 5 is a graph showing the relationship between the hardness HRC 58 case depth from the surface of the bearing ring and the life.

Referring to FIG. 5, the symbols ○ show the results when the inner and outer bearing rings and the rolling element have the same case depth of HRC 58. The symbols Δ and $\sqrt[3]{}$ shows the results when the case depth of HRC 58 of the rolling element are 120% and 140% of the case depth of HRC 58 of the bearing rings, respectively.

As a result, when the rolling element and the bearing rings have the same case depth of HRC 58, the larger the case depth becomes, the longer life is achieved. However, when the case depth exceeds 0.6 mm, prior spalling of the rolling element is caused and the life of the bearing is not improved. On the other hand, when the case depth of the rolling element is 140% of the case depth of the bearing rings (that is, the case depth of the rolling element is larger than the case depth of the bearing rings by 40%), prior spalling of the rolling element is prevented, and the relation between the bearing life and the case depth have linear correlation.

Thus, if the case depth of HRC 58 from the surface of the rolling element is at least 140% of the case depth of HRC 58 of the bearing rings, the rolling element will not be spalled prior to the bearing ring even under severe conditions, thus realizing a longer life.

As described above, the bearing steel part for the rolling bearing according to the present invention has an extremely large fracture toughness value as well as sufficient high temperature hardness and rolling contact fatigue strength. Therefore, even if it is rotated at high speed under large fit stress, spalling hardly occurs and, if it should be caused, the spalling will not lead to a crack that grows inside the bearing and damages it. Thus, the bearing steel part according to the present invention is extremely reliable. Therefore, the bearing steel part for the rolling bearing according to the present invention is a highly effective bearing steel part which can satisfy the future demand for high speed driving at the dn value of 4 million or more.

Since the depth of the high hardness region (having the hardness HRC of at least 58) from the surface of the rolling element is at least 140% of the high hardness depth of the bearing rings, the rolling element will not spalled prior to the bearing rings (inner and outer rings) even if it is under loads from both inner and outer ring sides, and the life of the bearing will be extended further.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A bearing part for a rolling bearing having a core portion and a high hardness region formed by carburization to cover said core portion, wherein said core portion contains Fe as a base, at least 0.15 wt. % and at most 0.20 wt. % of C, at least 4 wt. % and at most 7 wt. % of Cr, at least 1 wt. % and at most 3 wt. % of Mo, and at least 0.4 wt. % and at most 0.9 wt. % of V.

2. The bearing part for the rolling bearing according to claim 1, wherein hardness HRC of said core portion is at least 47 and at most 50, and hardness HRC of said high hardness region is at least 58.

3. A bearing part for a rolling bearing including inner and outer bearing rings and a rolling element positioned between said inner and outer bearing rings, said bearing part comprising:

a core portion and a high hardness region formed by carburization to cover said core portion;

wherein said core portion contains Fe as a base, at least 0.15 wt. % and at most 0.20 wt. % of C, at least 4 wt. % and at most 7 wt. % of Cr, at least 1 wt. % and at most 3 wt. % of Mo, and at least 0.4 wt. % and at most 0.9 wt. % of V, and wherein a depth of said high hardness region of said rolling element is at least 140% greater than a depth of said high hardness region of said bearing ring.

4. A bearing part for a rolling bearing having a core portion and a high hardness region formed by carburization to cover said core portion, wherein said core portion is made of a material consisting essentially of Fe as a base, at least 0.15 wt. % and at most 0.20 wt. % of C, at least 4 wt. % and at most 7 wt. % of Cr, at least 1 wt. % and at most 3 wt. % of Mo, and at least 0.4 wt. % and at most 0.9 wt. % of V.

* * * * *